US007454332B2

(12) United States Patent
Koishida et al.

(10) Patent No.: US 7,454,332 B2
(45) Date of Patent: Nov. 18, 2008

(54) GAIN CONSTRAINED NOISE SUPPRESSION

(75) Inventors: Kazuhito Koishida, Redmond, WA (US); Feng Zhuge, Stanford, CA (US); Hosam A. Khalil, Redmond, WA (US); Tian Wang, Redmond, WA (US); Wei-ge Chen, Issaquah, WA (US)

(73) Assignee: Microsoft Corporation, Redmond, WA (US)

( * ) Notice: Subject to any disclaimer, the term of this patent is extended or adjusted under 35 U.S.C. 154(b) by 756 days.

(21) Appl. No.: 10/869,467

(22) Filed: Jun. 15, 2004

(65) Prior Publication Data

US 2005/0278172 A1 Dec. 15, 2005

(51) Int. Cl.
*G10L 21/02* (2006.01)
*G10L 19/14* (2006.01)

(52) U.S. Cl. ..... 704/227; 704/226; 704/211; 704/225; 704/223; 381/94.3

(58) Field of Classification Search ..... 704/210, 704/211, 226–228, 233, 225; 381/94.3
See application file for complete search history.

(56) References Cited

U.S. PATENT DOCUMENTS 4,630,305 A * 12/1986 Borth et al. ..... 381/94.3
4,811,404 A * 3/1989 Vilmur et al. ..... 381/94.3
5,012,519 A * 4/1991 Adlersberg et al. ..... 704/226
5,406,635 A * 4/1995 Jarvinen ..... 381/94.3
5,550,924 A * 8/1996 Helf et al. ..... 381/94.3

(Continued)

FOREIGN PATENT DOCUMENTS

| | | |
|---|---|---|
| CA | 2395769 | 2/2003 |
| EP | 588526 | 3/1994 |
| WO | WO 87/00366 | 1/1987 |

OTHER PUBLICATIONS

S.F. Boll, A.V. Oppenheim, "Suppression of acoustic noise in speech using spectral subtraction," *IEEE Trans. Acoustics, Speech and Signal Processing*, ASSP-27(2), Apr. 1979.

(Continued)

*Primary Examiner*—Vijay B Chawan
(74) *Attorney, Agent, or Firm*—Klarquist Sparkman, LLP

(57) ABSTRACT

A gain-constrained noise suppression for speech more precisely estimates noise, including during speech, to reduce musical noise artifacts introduced from noise suppression. The noise suppression operates by applying a spectral gain G(m, k) to each short-time spectrum value S(m, k) of a speech signal, where m is the frame number and k is the spectrum index. The spectrum values are grouped into frequency bins, and a noise characteristic estimated for each bin classified as a "noise bin." An energy parameter is smoothed in both the time domain and the frequency domain to improve noise estimation per bin. The gain factors G(m, k) are calculated based on the current signal spectrum and the noise estimation, then smoothed before being applied to the signal spectral values S(m, k). First, a noisy factor is computed based on a ratio of the number of noise bins to the total number of bins for the current frame, where a zero-valued noisy factor means only using constant gain for all the spectrum values and noisy factor of one means no smoothing at all. Then, this noisy factor is used to alter the gain factors, such as by cutting off the high frequency components of the gain factors in the frequency domain.

15 Claims, 7 Drawing Sheets

U.S. PATENT DOCUMENTS

| | | | | |
|---|---|---|---|---|
| 5,706,395 | A * | 1/1998 | Arslan et al. | 704/226 |
| 5,768,473 | A * | 6/1998 | Eatwell et al. | 704/226 |
| 5,943,429 | A | 8/1999 | Handel | |
| 6,088,668 | A * | 7/2000 | Zack | 704/225 |
| 6,122,610 | A * | 9/2000 | Isabelle | 704/226 |
| 6,144,937 | A * | 11/2000 | Ali | 704/233 |
| 6,289,309 | B1 * | 9/2001 | deVries | 704/233 |
| 6,317,709 | B1 | 11/2001 | Zack | |
| 6,415,253 | B1 * | 7/2002 | Johnson | 704/210 |
| 6,507,623 | B1 | 1/2003 | Gustafsson et al. | |
| 6,766,292 | B1 * | 7/2004 | Chandran et al. | 704/224 |
| 6,839,666 | B2 * | 1/2005 | Chandran et al. | 704/226 |
| 2004/0049383 | A1 * | 3/2004 | Kato et al. | 704/226 |

OTHER PUBLICATIONS

S. F. Boll, "Improving linear prediction analysis of noisy speech by predictive noise cancellation," in hoc. *IEEE Znt. Coni on Acoust., Speech, Signal Processing*, Philadelphia, PA, pp. 10-13, Apr. 12-14, 1976.

B. Widrow et al., "Adaptive noise cancelling: principles and applications," *Proc. IEEE*, vol. 63, pp. 1692-1716, Dec. 1975.

S. F. Boll and D. Pulsipher, "Noise suppression methods for robust speech processing," Dep. Comput. Sci., Univ. Utah, Salt Lake City, Semi-Annu. Tech. Rep., Utec-CSc-77-202, pp. 50-54, Oct. 1977.

J. Allen, "Short term spectral analysis, synthesis, and modification by discrete Fourier transform," *IEEE Trans. Acoust., Speech, Signal Processing*, vol. ASSP-25, pp. 235-239, Jun. 1977, 1976, pp. 10-13, ASSP-25, pp. 310-322, Aug. 1977.

Rainer Martin, "Noise Power Spectral Density Estimation Based on Optimal Smoothing and Minimum Statistics," *IEEE Transactions on Speech and Audio Processing*, vol. 9, pp. 504-512, Jul. 2001.

"Clarity, One Microphone Solution, A Clear Voice Capture (CVC™) technology white paper," 2002.

Ing Yann Soon and Soo Ngee Koh, "Speech Enhancement Using 2-D Fourier Transform," *IEEE Transactions on Speech and Audio Processing*, vol. 11, No. 6, Nov. 2003, available at http://www.ntu.edu.sg/home/eiysoon/soon2d.pdf.

Levent Arslan, Alan McCree, and Vishu Viswanathan, "New Methods For Adaptive Noise Suppression," Systems and Information Science Laboratory, Texas Instruments, *Proc. ICASSP*, Detroit, May 1995.

* cited by examiner

Windowing Function (w(n))
300

Software 780 Implementing gain-constrained noise suppression

GAIN CONSTRAINED NOISE SUPPRESSION

TECHNICAL FIELD

The invention relates generally to digital audio signal processing, and more particularly relates to noise suppression in voice or speech signals.

BACKGROUND

Noise suppression (NS) of speech signals can be useful to many applications. In cellular telephony, for example, noise suppression can be used to remove background noise to provide more readily intelligible speech from calls made in noisy environments. Likewise, noise suppression can improve perceptual quality and speech intelligibility in teleconferencing, voice chat in on-line games, Internet-based voice messaging and voice chat, and other like communications applications. The input audio signal is typically noisy for these applications since the recording environment is less than ideal. Further, noise suppression can improve compression performance when used prior to coding or compression of voice signals (e.g., via the Windows Media Voice codec, and other like codecs). Noise suppression also can be applied prior to speech recognition to improve recognition accuracy.

There are some well-known techniques for noise suppression in speech signals, such as spectral subtraction and Minimum Mean Square Error (MMSE). Almost all of these known techniques suppress the noise by applying a spectral gain G(m, k) based on an estimate of noise in the speech signal to each short-time spectrum value S(m, k) of the speech signal, where m is the frame number and k is the spectrum index. (See, e.g., S. F. Boll, A. V. Oppenheim, "Suppression of acoustic noise in speech using spectral subtraction," IEEE Trans. Acoustics, Speech and Signal Processing, ASSP-27 (2), April 1979; and Rainer Martin, "Noise Power Spectral Density Estimation Based on Optimal Smoothing and Minimum Statistics," IEEE Transactions on Speech and Audio Processing, Vol. 9, No. pp. 504-512, July 2001.) A very low spectral gain is applied to spectrum values estimated to contain noise, so as to suppress the noise in the signal.

Unfortunately, the use of noise suppression may introduce artificial distortions (audible "artifacts") into the speech signal, such as because the spectral gain applied by the noise suppression is either too great (removing more than noise) or too little (failing to remove the noise completely). One artifact that many NS techniques suffer from is called musical noise, where the NS technique introduces an artifact perceived as a melodic audio signal pattern that was not present in the input. In some cases, this musical noise can become noticeable and distracting, in addition to being an inaccurate representation of the speech present in the input signal.

SUMMARY

In a speech noise suppressor implementation described herein, a novel gain-constrained technique is introduced to improve noise suppression precision and thereby reduce occurrence of musical noise artifacts. The technique estimates the noise spectrum during speech, and not just during pauses in speech, so that the noise estimation can be kept more accurate during long speech periods. Further, a noise estimation smoothing is used to achieve better noise estimation. The listening test shows this gain-constrained noise suppression and noise estimation smoothing techniques improve the voice quality of speech signals significantly.

The gain-constrained noise suppression and smoothed noise estimation techniques can be used in noise suppressor implementations that operate by applying a spectral gain G(m, k) to each short-time spectrum value S(m, k). Here m is the frame number and k is the spectrum index.

More particularly in one example noise suppressor implementation, the input voice signal is divided into frames. An analysis window is applied to each frame and then the signal is converted into a frequency domain signal S(m, k) using the Fast Fourier Transform (FFT). The spectrum values are grouped into N bins for further processing. A noise characteristic is estimated for each bin when it is classified as being a noise bin. An energy parameter is smoothed in both the time domain and the frequency domain to get better noise estimation per bin. The gain factors G(m, k) are calculated based on the current signal spectrum and the noise estimation. A gain smoothing filter is applied to smooth the gain factors before they are applied on the signal spectral values S(m, k). This modified signal spectrum is converted into time domain for output.

The gain smoothing filter performs two steps to smooth the gain factors before they are applied to the spectrum values. First, a noisy factor $\xi(m) \in [0,1]$ is computed for the current frame. It is determined based on a ratio of the number of noise bins to the total number of bins. A zero-valued noisy factor $\xi(m)=0$ means only using constant gain for all the spectrum values, whereas a noisy factor $\xi(m)=1$ means no smoothing at all. Then, this noisy factor is used to alter the gain factors G(m, k) to produce smoothed gain factors $G_S(m, k)$. In the example noise suppressor implementation, this is done by applying the FFT on G(m, k), then cutting off the high frequency components.

Additional features and advantages of the invention will be made apparent from the following detailed description of embodiments that proceeds with reference to the accompanying drawings.

DETAILED DESCRIPTION

Figure 1:
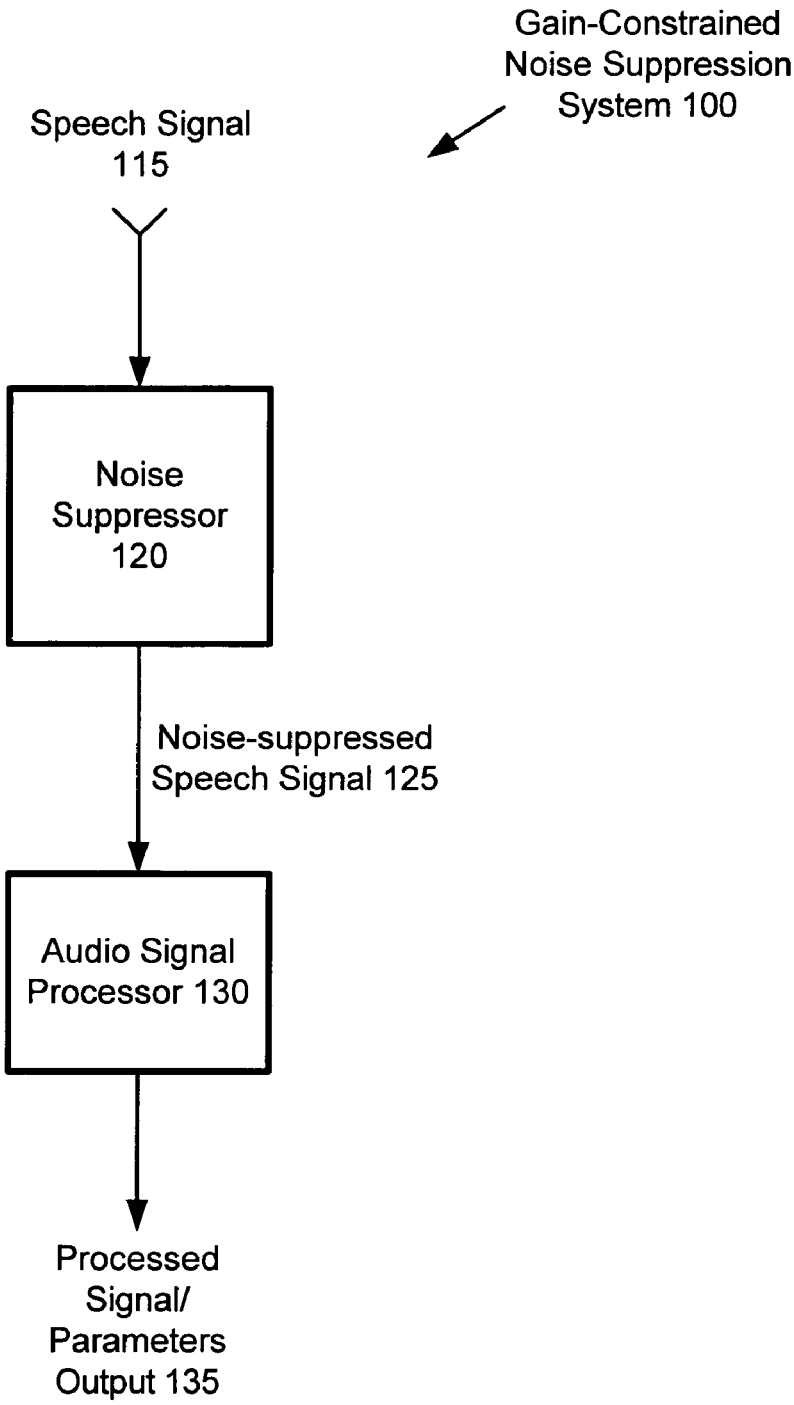
FIG. 1 is a block diagram of a speech noise suppressor that implements the gain-constrained noise suppression technique described herein.

The following description is directed to gain-constrained noise suppression techniques for use in audio or speech processing systems. As illustrated in FIG. 1, this gain-constrained noise suppression technique can be applied to a speech signal 115 as a pre-process (by the noise suppressor 120) in a gain-constrained noise suppression system 100 prior to processing the resulting noise-suppressed speech signal 125 by various kinds of audio signal processors 130 (such as coding or compression, voice chat or teleconferencing, speech recognition, and etc.). The audio signal processor produces processed signal output 135 (such as a speech or audio signal, speech recognition or other analysis parameters, and etc.), which may be improved (e.g., in perceptual quality, recognition or analysis precision, etc.) by the gain-constrained noise suppression.

1. Illustrated Embodiment

Figure 2:
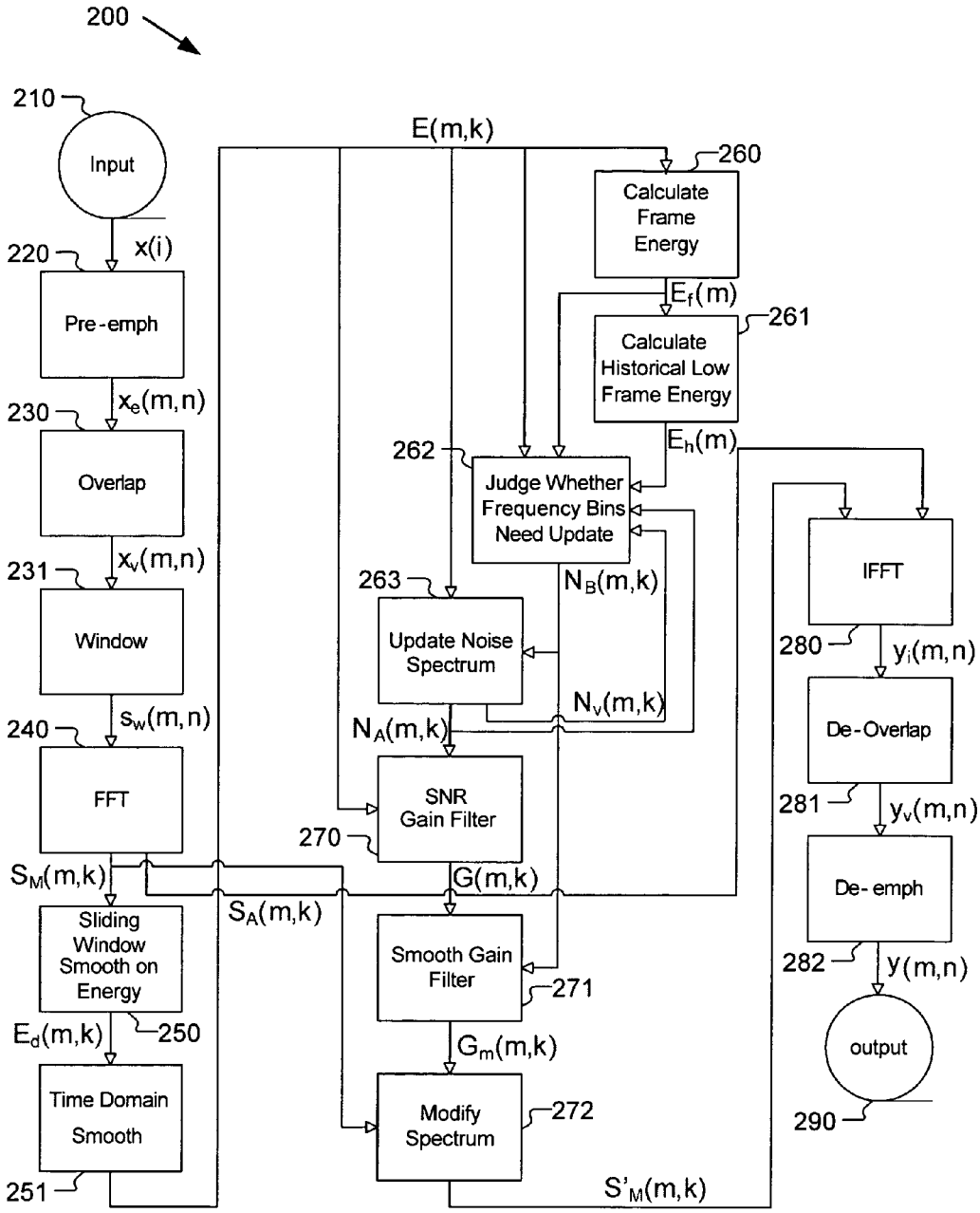
FIG. 2 is a flow diagram illustrating a gain-constrained noise suppression process performed in the speech noise suppressor of FIG. 1.

FIG. 2 illustrates a gain-constrained noise suppression processing 200 that is performed in the noise suppressor 120 (FIG. 1). The gain-constrained noise suppression processing 200 begins with input 210 of a speech signal, such as from a microphone or speech signal recording. The speech signal is digitized or time-sampled at a sampling rate, $F_s$, which can typically be 8000, 11025, 16000, 22050 Hz or other rate suitable to the application. The input speech signal then has the form of a sequence or stream of speech signal samples, denoted as x(i).

At a pre-emphasis stage 220, this input speech signal (x(i)) is processed to emphasize speech, e.g., via a high-pass filtering (although other forms of emphasis can alternatively be used). First, framing is performed to group the speech signal samples into frames of a preset length, N, which may be 160 samples. The framed speech signal is denoted as x(m,n), where m is the frame number, and n is the number of the sample within the frame. A suitable high-pass filtering for emphasis can be represented in the following formula:

$$H(z)=1+\beta z^{-1}$$

with a suitable value of β being −0.8. This high pass filter can be realized by calculating the emphasized speech signal, $x_h(m,n)$, as a weighted moving average of the corresponding sample of the input speech signal with its immediately preceding sample, as in the following equation:

$$x_h(m,n)=x(m,n)+\beta x(m,n-1)$$

Figure 3:
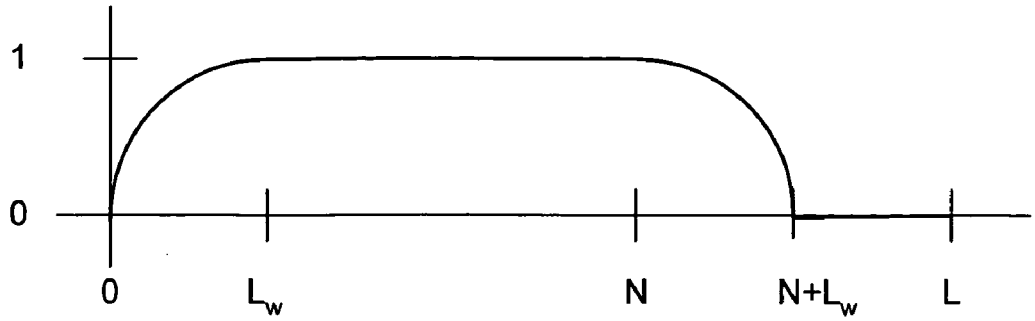
FIG. 3 is a graph illustrating an overlapped windowing function applied to the input speech signal in the gain-constrained noise suppression process of FIG. 2.

A windowing function 300 (shown in FIG. 3) is then applied on an overlap frame function of the speech-emphasized signal at overlap stage 230 and window stage 231. In one example implementation, the windowing function w(n) with window length (L=256) and frame overlap ($L_w$=48) is given by:

$$w(n)=\begin{cases}\frac{1}{2}\left(1-\cos\frac{n}{L_w}\pi\right), & 0\le n<L_w\\ 1, & L_w\le n<N\\ \frac{1}{2}\left(1-\cos\frac{N+L_w-n-1}{L_w}\pi\right), & N\le n<N+L_w\\ 0, & N+L_w\le n<L\end{cases}$$

This windowing function is multiplied by an overlapped frame ($x_w$) of the emphasized (high-pass filtered) signal, $x_h(m,n-L_w)$, given by:

$$x_w(n)=\begin{cases}x_h(m-1,n+N-L_w), & 0\le n<L_w\\ x_h(m,n), & L_w\le n<N+L_w\\ 0, & N+L_w\le n<L\end{cases}$$

The multiplication produces a windowed signal, $s_w(m,n)$, as in the following equation:

$$s_w(m,n)=x_w(n)w(n),\ 0\le n<L$$

After windowing, the speech signal is transformed via a frequency analysis (e.g., using the Fast Fourier Transform (FFT) 240 or other like transform) to the frequency domain. This yields a set of spectral coefficients or frequency spectrum for each frame of the signal, as shown in the following equation:

$$S(m,k)=FFT_L(s_w(m,n))$$

The spectral coefficients are complex values, and thus represent both the spectral amplitude ($S_A$) and phase ($S_P$) of the speech signal according to the following relationships:

$$S_A(m,k)=|S(m,k)|$$

$$S_P(m,k)=\tan^{-1}S(m,k)$$

The spectral amplitude is analyzed in the following process to provide a more accurate estimate of the gain to be used in noise suppression, whereas the phase is preserved for use in the inverse FFT.

At stages 250-251, frequency and time domain smoothing is performed on the energy bands of the spectrum for each frame. A sliding window smoothing in the frequency domain is first performed is as in the following equation:

$$S_0(m,k)=\frac{1}{2k_s+1}\sum_{k=k-k_s}^{k+k_s}S_A^2(m,k)$$

This is followed by a time domain smoothing given by the following equation:

$$S_s(m,k)=\begin{cases}S_0(m,k), & m=0\\ \alpha S_0(m-1,k)+(1-\alpha)S_0(m,k), & m>0\end{cases}$$

where $$\alpha=\frac{\frac{\gamma}{N/F_s}-1}{\frac{\gamma}{N/F_s}+1}$$

Here, the value of γ is a parameter that can be variably chosen to control the amount of smoothing. In particular, as the value of γ approaches the ratio ($N/F_s$), then a goes to zero, resulting in less smoothing when the above time domain smoothing is applied. On the other hand, as the value is made larger (γ→∞), then α approaches a unity value, producing greater smoothing.

Stages 260 and 261 calculate the frame energy and historical lowest energy, respectively. The frame energy is calculated from the following equation:

$$S_E(m)=\sum_{k=0}^{k-1}S_s(m,k)$$

The historical lowest energy is given by:

$$S_{\min}(m)=\min_{l=m-M+1}^{m-1}S_E(l)$$

where M is a constant parameter typically representing 1 or 2 seconds.

At an update checking stage 262, the noise suppressor 120 judges whether to update noise statistics of the speech signal that are tracked on a frequency bin basis. The noise suppressor 120 groups the spectrum values of the speech signal frames into a number of frequency bins. In the illustrated implementation, the spectrum values (k) are grouped one spectrum value per frequency bin. However, in alternative implementations, various other groupings of the frames' spectrum values into frequency bins can be made, such as more than one spectrum value per frequency bin, or non-uniform groupings of spectrum values into frequency bins.

Figure 4:
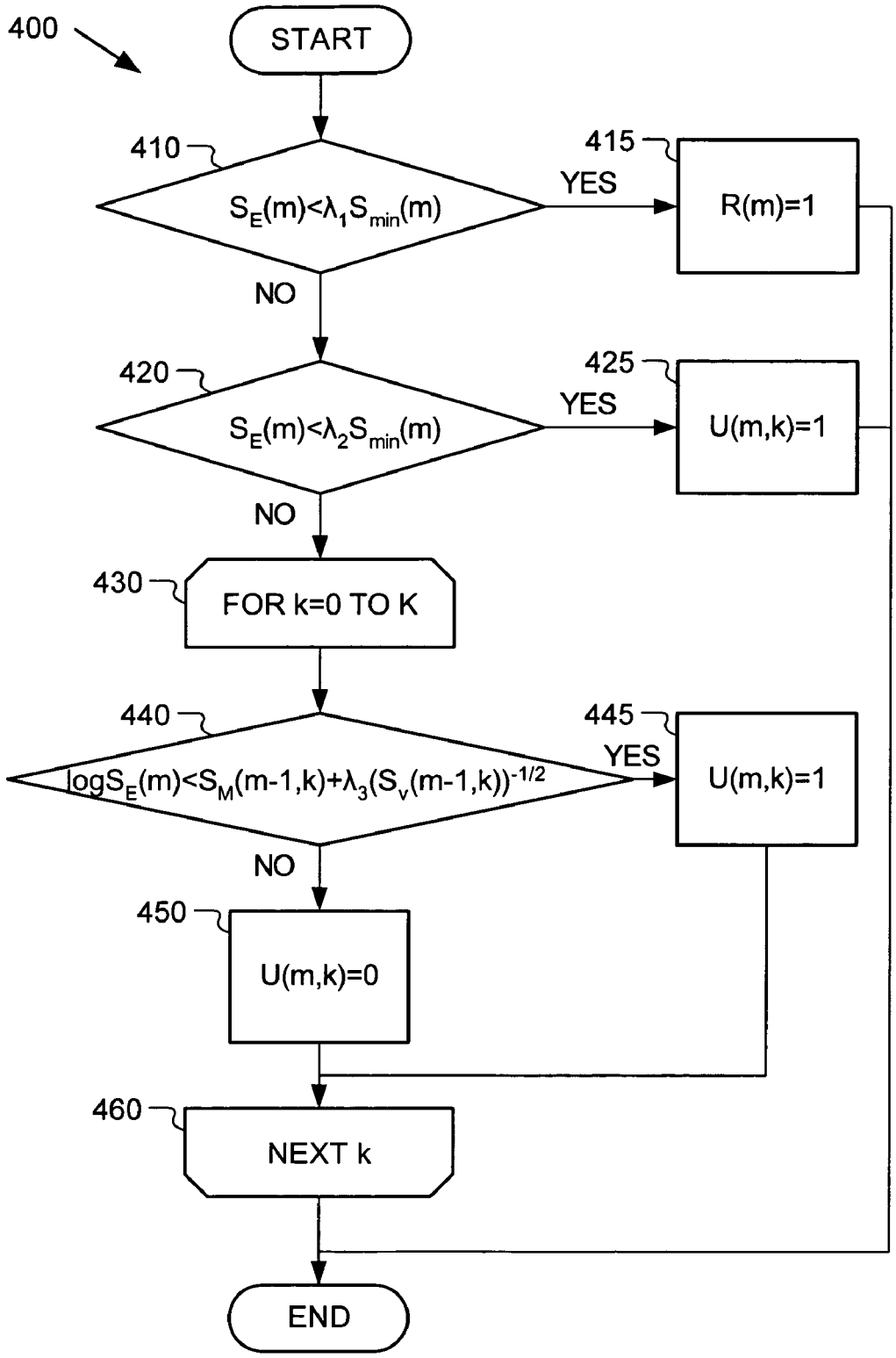
FIG. 4 is a flow chart showing an update determination check performed in the gain-constrained noise suppression process of FIG. 2.

FIG. 4 illustrates a procedure 400 used at the update checking stage 270 (FIG. 2) by the noise suppressor 120 (FIG. 1) to determine whether and how noise statistics for the speech signal are updated. In this procedure 400, the noise suppressor determines whether to reset the noise statistics in the current speech signal frame, and also determines whether to update the noise statistics of individual frequency bins. The noise suppressor executes this procedure on each frame of the speech signal.

First, in determining whether to reset the noise statistics, the noise suppressor checks (decision 410) whether the frame energy is below a first threshold multiple ($\lambda_1$) of the historical lowest energy for the speech signal (which generally indicates a pause in speech), as shown in the following equation:

$$S_E(m)<\lambda_1 S_{min}(m)$$

If so (at block 415), the noise suppressor sets a reset flag for the frame to one (R(m)=1), which indicates the noise statistics are to be reset in the current frame.

Otherwise, the noise suppressor proceeds to check whether to update the frequency bins. For this check (decision 420), the noise suppressor checks whether the frame energy is below a second (higher) threshold multiple ($\lambda_2$) of the historical lowest energy (which generally indicates a continuing speech pause), as in the following equation:

$$S_E(m)<\lambda_2 S_{min}(m)$$

If so, the noise suppressor sets the update flags for the frame's frequency bins to one (i.e., U(m,k)=1).

Otherwise (inside "for" loop blocks 430, 460), the noise suppressor makes determination on a per frequency bin basis whether to update the respective frequency bin. For each frequency bin, the noise suppressor checks whether the frame energy is lower than a function of the noise mean and noise variance of the respective frequency bin in the preceding frame (decision 440), as shown in the following equation:

$$\log S_E(m)<S_M(m-1,k)+\lambda_3\sqrt{S_V(m-1,k)}$$

If the logarithmic energy of the frequency bin is lower than this threshold function of the noise mean and variance of the frequency bin in the preceding frame, then the noise suppressor sets the update flag for the frequency bin to one (U(m,k)=1) at block 445. The update flag for the current frequency bin is otherwise set to zero (U(m,k)=0) for no update, at block 445.

With reference again to FIG. 2, the noise suppressor at block 263 updates the noise spectrum statistics per frequency bin according to the update determinations made at block 262. The noise statistics tracked per frequency bin include the noise mean and noise variance.

Figure 5:
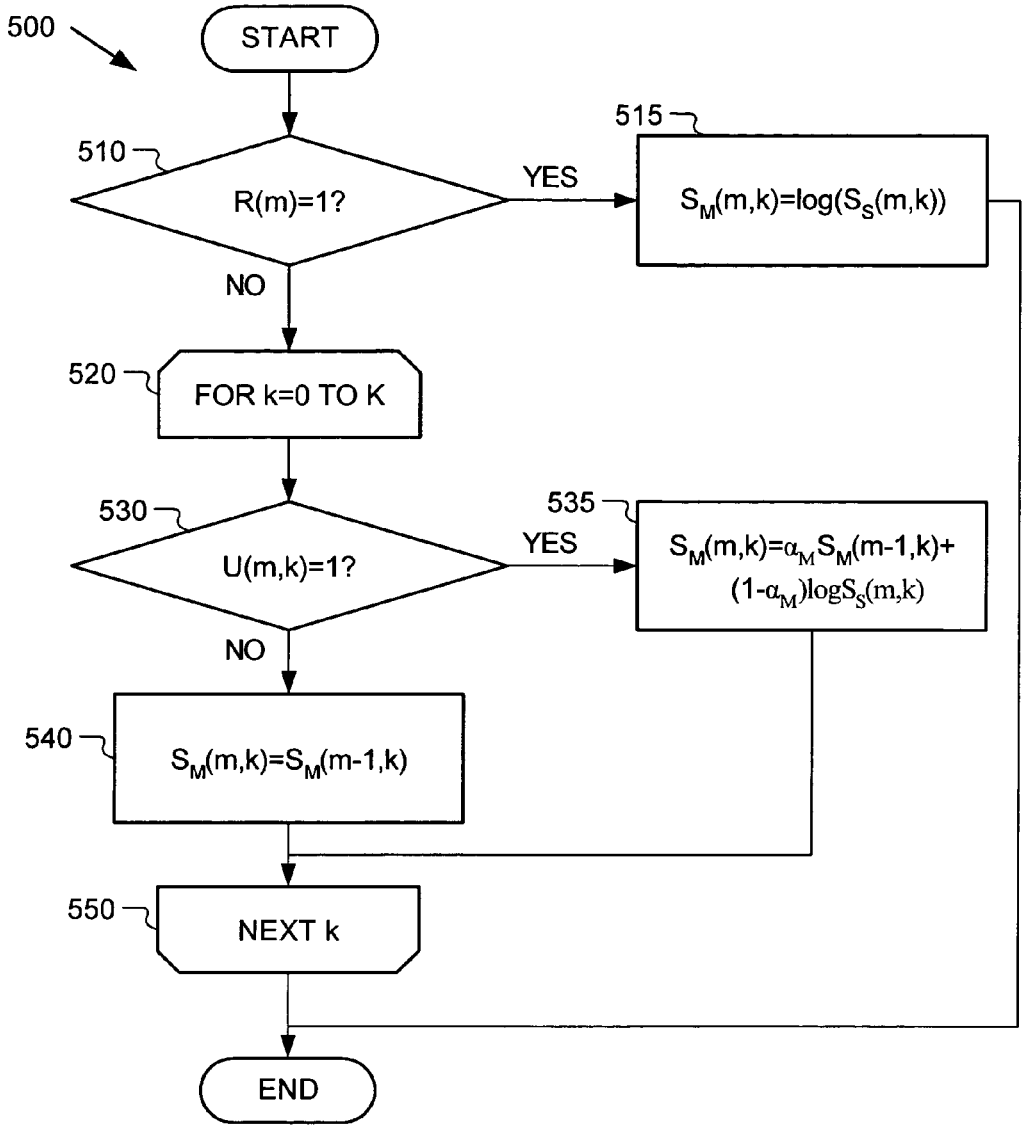
FIGS. 5 and 6 are flow charts showing updating of noise statistics (mean and variance, respectively) based on the update determination check performed in the gain-constrained noise suppression process of FIG. 2.

FIG. 5 illustrates a procedure 500 for updating the noise mean for a speech signal frame. At an initial decision 510 of the noise mean update procedure 500, the noise suppressor checks whether the reset flag indicates that the noise statistics for the frame are to be reset (i.e., if R(m)=1). If so, the noise suppressor resets the noise mean calculation for the frequency bins (0≦k<K), as in the following equation:

$$S_M(m,k)=\log S_S(m,k)$$

Otherwise, if the reset flag for the frame is not set (R(m)≠1), the noise suppressor updates the noise mean for the frequency bins according to their update flags. In "for" loop 520, 550, the noise suppressor checks the update flag of each frequency bin (decision 530). If the update flag is set (U(m,k)=1), the noise mean for the frequency bin is updated as a weighted sum of the noise mean of the frequency bin in the preceding frame and the speech signal of the frequency bin in the present frame, as shown in the following equation:

$$S_M(m,k)=\alpha_M S_M(m-1,k)+(1-\alpha_M)\log S_S(m,k)$$

Otherwise, the noise mean of the frequency bin is not updated, and therefore carried forward from the preceding frame, as in the following equation:

$$S_M(m,k)=S_M(m-1,k)$$

Figure 6:
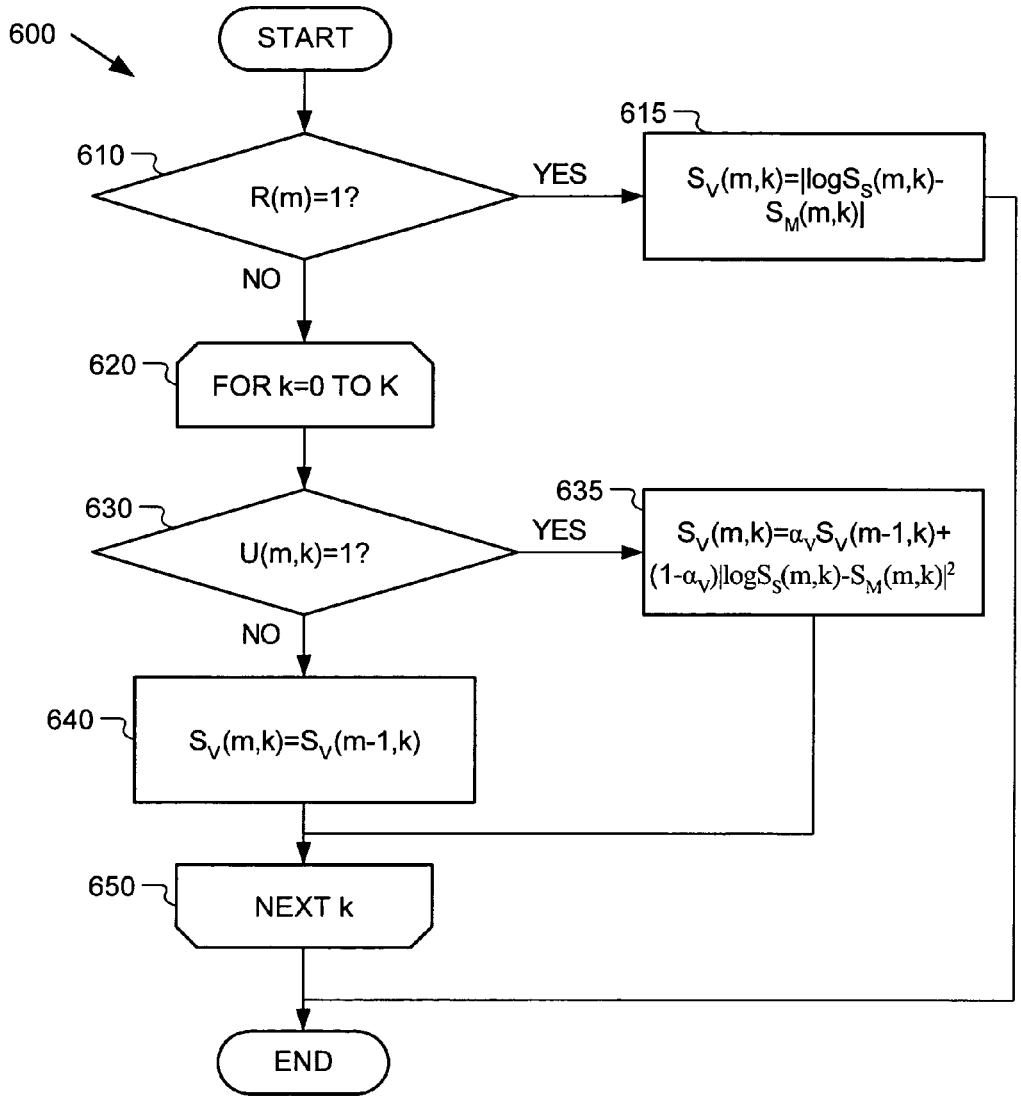

FIG. 6 illustrates a procedure 600 for updating the noise variance for a speech signal frame. At an initial decision 610 of the noise mean update procedure 600, the noise suppressor checks whether the reset flag indicates that the noise statistics for the frame are to be reset (i.e., if R(m)=1). If so, the noise suppressor resets the noise variance calculation for the frequency bins (0≦k<K), as in the following equation:

$$S_V(m,k)=|\log S_S(m,k)-S_M(m,k)|^2$$

Otherwise, if the reset flag for the frame is not set (R(m)≠1), the noise suppressor updates the noise variance for the frequency bins according to their update flags. In "for" loop 620, 650, the noise suppressor checks the update flag of each frequency bin (decision 630). If the update flag is set (U(m,k)=1), the noise variance for the frequency bin is updated as a weighted function of the noise variance of the frequency bin in the preceding frame and that of the speech signal of the frequency bin in the present frame, as shown in the following equation:

$$S_V(m,k)=\alpha_V S_V(m-1,k)+(1-\alpha_V)|\log S_S(m,k)-S_M(m,k)|^2$$

Otherwise, the noise variance of the frequency bin is not updated, and therefore carried forward from the preceding frame, as in the following equation:

$$S_V(m,k)=S_V(m-1,k)$$

With reference again to FIG. 2, the noise suppressor in the next stages 270-271 of the gain constrained noise suppression processing 200 calculates and smoothes gain factors (G(m,k)) based on the current signal spectrum and noise estimation from stage 263 to be applied as a gain filter to modify the speech signal spectrum at stage 272.

In a Signal-to-Noise Ratio (SNR) gain filter stage 270, the noise suppressor initially calculates the SNR of the frequency bins, as in the following equation:

$$SNR(m,k)=\frac{S_S(m,k)}{\exp(S_M(m,k))}$$

The noise suppressor then uses the SNR to calculate the gain factors for the gain filter, as follows:

$$G(m,k)=\sqrt{\frac{SNR(m,k)-\gamma_a}{\gamma_b}}$$

$$G(m,k)=\begin{cases} G_{min}, & G(m,k)<G_{min} \\ G(m,k), & G_{min}\le G(m,k)<G_{max} \\ G_{max}, & G_{max}\le G(m,k) \end{cases}$$

In a gain smoothing stage 271, the noise suppressor then smoothes the gain factors according to a calculation of the "noisy"-ness (herein termed a "noisy factor") of the frame, where a stronger smoothing is applied to more noisy frames than is applied to speech frames. The noise suppressor calculates a noise ratio for the frame as a ratio of the number of noisy frequency bins (i.e., the bins flagged for update) to the total number of bins, as follows:

$$R_N(m) = \frac{1}{K}\sum_{k=0}^{K-1} U(m, k)$$

The noise suppressor then calculates a smoothing factor for the frame (clamped to the range 0 to 1), as follows:

$$M(m) = (M_{\max} - M_{\min})R_N(m) + M_{\min}$$

$$M(m) = \begin{cases} 0, & M(m) < 0 \\ M(m), & 0 \le M(m) < 1 \\ 1, & 1 \le M(m) \end{cases}$$

In this implementation, the noise suppressor applies smoothing in the frequency domain, using the FFT to transform the gain filter to the frequency domain. For the frequency domain transform, the noise suppressor calculates a set of expanded gain factors (G'(m,k)) from the gain factors (G(m,k)), as follows:

$$G'(m, k) = \begin{cases} G(m, k), & 0 < k < K \\ G(m, L-k), & K \le k < L \end{cases}$$

where K is the number of frequency bins. L is typically 2K. The expanded gain factors thus effectively copy the gain factors from 0 to K−1, and copy a mirror image of the gain factors from K to L−1.

The noise suppressor then calculates a gain spectrum (g(Λ)) via the FFT of the expanded gain factors, as follows:

$$g(\overline{\Lambda})=FFT(G'(m,k))$$

The FFT produces spectrum coefficients having complex values, from which amplitude and phase of the gain spectrum are calculated as follows:

$$g_A(\overline{\Lambda})=|g(\overline{\Lambda})|$$

$$g_P(\overline{\Lambda})=\tan^{-1}(g(\overline{\Lambda}))$$

The noise suppressor then smoothes the gain filter by zeroing high frequency components of the gain spectrum. The noise suppressor retains a number of gain spectrum coefficients up to a number based on the smoothing factor (M(m)) and zeroing the components above this number, according to the following equation:

$$N_g=\text{roundoff}[(1-M(m))(k-1)]+1$$

such that, $$g'_A(\overline{\Lambda}) = \begin{cases} g_A(\overline{\Lambda}), & 0 \le \overline{\Lambda} < N_g \\ 0, & N_g \le \overline{\Lambda} \end{cases}$$

An inverse FFT is then applied to this reduced gain spectrum to produce the smoothed gain filter, by:

$$G_S(m,k)=IFFT(g'_A(\overline{\Lambda}),g_P(\overline{\Lambda}))$$

This FFT based smoothing effectively produces little or no smoothing for a smoothing factor near zero (e.g., with no or few "noisy" frequency bins marked by the update flag in the frame), and smoothes the gain filter toward a constant value as the smoothing factor approaches one (e.g., with all or nearly all "noisy" bins). Accordingly, for a zero smoothing factor (M(m)=0), the smoothed gain filter is:

$$G_s(m,k)=G(m,k)$$

Whereas, for a smoothing factor equal to one (M(m)=1), the smoothed gain filter is:

$$G_s(m, k) = \frac{1}{k}\sum_{i=0}^{k-1} G(m, i)$$

At a next stage 272, the noise suppressor applies the resulting smoothed gain filter to the spectral amplitude of speech signal frame, as follows:

$$S'_A(m,k)=S_A(m,k)G_s(m,k)$$

As a result of the noise statistic estimation and smoothing processes, the gain factors applied to noisy bins should be much lower relative to non-noise frequency bins, such that noise in the speech signal is suppressed.

At stage 280, the noise suppressor applies the inverse transform to the spectrum of the speech signal as modified by the gain filter, as follows:

$$y_o(m,n)=IFFT_L(S'_A(m,k),S_P(m,k))$$

An inverse of the overlap and pre-emphasis (high-pass filtering) are then applied at stages 281, 282 to produce the final output 290 of the noise suppressor, as per the following formulas:

$$y_1(m, n) = \begin{cases} y_0(m-1, n+N) + y_0(m, n), & 0 \le n < N-L \\ y_0(m, n), & N-L \le n < N \end{cases}$$

$$y(m, n) = y_1(m, n) - \beta y(m, n-1)$$

2. Computing Environment

The above described noise suppression system 100 (FIG. 1) and gain-constrained noise suppression processing 200 can be implemented on any of a variety of devices in which audio signal processing is performed, including among other examples, computers; audio playing, transmission and receiving equipment; portable audio players; audio conferencing; Web audio streaming applications; and etc. The gain-constrained noise suppression can be implemented in hardware circuitry (e.g., in circuitry of an ASIC, FPGA, etc.), as well as in audio processing software executing within a computer or other computing environment (whether executed on the central processing unit (CPU), or digital signal processor, audio card or like), such as shown in FIG. 7.

Figure 7:
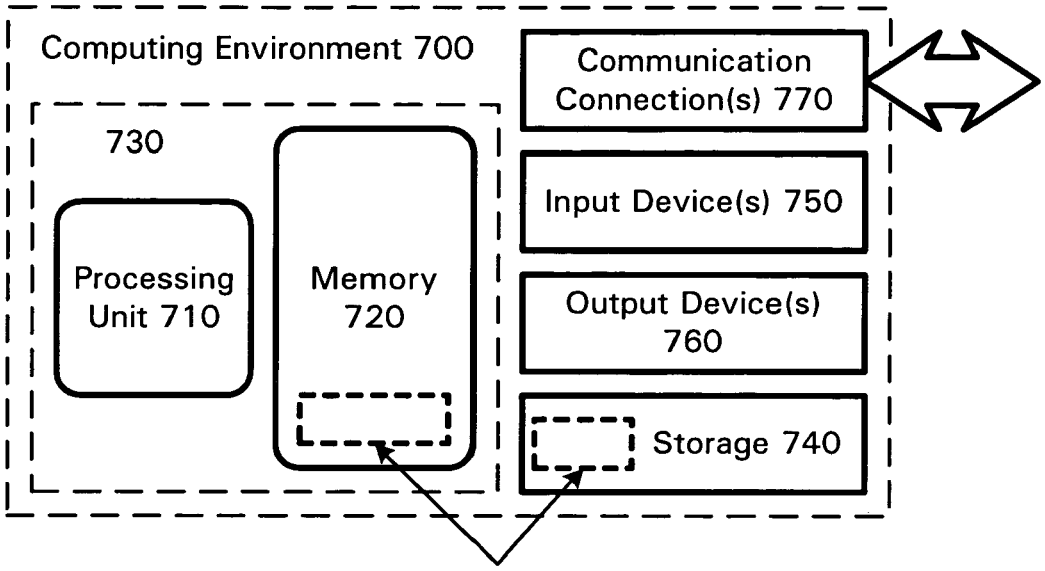
FIG. 7 is a block diagram of a suitable computing environment for implementing the speech noise suppressor of FIG. 1.

FIG. 7 illustrates a generalized example of a suitable computing environment (700) in which the described gain-constrained noise suppression may be implemented. The computing environment (700) is not intended to suggest any limitation as to scope of use or functionality of the invention, as the present invention may be implemented in diverse general-purpose or special-purpose computing environments.

With reference to FIG. 7, the computing environment (700) includes at least one processing unit (710) and memory (720).

In FIG. 7, this most basic configuration (730) is included within a dashed line. The processing unit (710) executes computer-executable instructions and may be a real or a virtual processor. In a multi-processing system, multiple processing units execute computer-executable instructions to increase processing power. The memory (720) may be volatile memory (e.g., registers, cache, RAM), non-volatile memory (e.g., ROM, EEPROM, flash memory, etc.), or some combination of the two. The memory (720) stores software (780) implementing the described gain-constrained noise suppression techniques.

A computing environment may have additional features. For example, the computing environment (700) includes storage (740), one or more input devices (750), one or more output devices (760), and one or more communication connections (770). An interconnection mechanism (not shown) such as a bus, controller, or network interconnects the components of the computing environment (700). Typically, operating system software (not shown) provides an operating environment for other software executing in the computing environment (700), and coordinates activities of the components of the computing environment (700).

The storage (740) may be removable or non-removable, and includes magnetic disks, magnetic tapes or cassettes, CD-ROMs, CD-RWs, DVDs, or any other medium which can be used to store information and which can be accessed within the computing environment (700). The storage (740) stores instructions for the software (780) implementing the gain-constrained noise suppression processing 200 (FIG. 2).

The input device(s) (750) may be a touch input device such as a keyboard, mouse, pen, or trackball, a voice input device, a scanning device, or another device that provides input to the computing environment (700). For audio, the input device(s) (750) may be a sound card or similar device that accepts audio input in analog or digital form, or a CD-ROM reader that provides audio samples to the computing environment. The output device(s) (760) may be a display, printer, speaker, CD-writer, or another device that provides output from the computing environment (700).

The communication connection(s) (770) enable communication over a communication medium to another computing entity. The communication medium conveys information such as computer-executable instructions, compressed audio or video information, or other data in a modulated data signal. A modulated data signal is a signal that has one or more of its characteristics set or changed in such a manner as to encode information in the signal. By way of example, and not limitation, communication media include wired or wireless techniques implemented with an electrical, optical, RF, infrared, acoustic, or other carrier.

The fast headphone virtualization techniques herein can be described in the general context of computer-readable media. Computer-readable media are any available media that can be accessed within a computing environment. By way of example, and not limitation, with the computing environment (700), computer-readable media include memory (720), storage (740), communication media, and combinations of any of the above.

The fast headphone virtualization techniques herein can be described in the general context of computer-executable instructions, such as those included in program modules, being executed in a computing environment on a target real or virtual processor. Generally, program modules include routines, programs, libraries, objects, classes, components, data structures, etc. that perform particular tasks or implement particular abstract data types. The functionality of the program modules may be combined or split between program modules as desired in various embodiments. Computer-executable instructions for program modules may be executed within a local or distributed computing environment.

For the sake of presentation, the detailed description uses terms like "determine," "generate," "adjust," and "apply" to describe computer operations in a computing environment. These terms are high-level abstractions for operations performed by a computer, and should not be confused with acts performed by a human being. The actual computer operations corresponding to these terms vary depending on implementation.

In view of the many possible embodiments to which the principles of our invention may be applied, we claim as our invention all such embodiments as may come within the scope and spirit of the following claims and equivalents thereto.

We claim:

1. A speech noise suppression method, comprising:

transforming a frame of an input speech signal to a frequency domain representation having a plurality of spectral values;

classifying a plurality of frequency bins as noisy or non-noisy;

calculating a plurality of gain factors for the frequency bins;

calculating a noisy factor based on a ratio of a number of noisy frequency bins to a total number of frequency bins, varying from a value indicative of no smoothing to a value indicative of smoothing the gain factors to a constant gain;

smoothing the gain factors in accordance with the noisy factor; and modifying the spectral values by applying the gain factors to correlated spectral values; and transforming the modified spectral values to produce an output speech signal.

2. The speech noise suppression method of claim 1, wherein the smoothing the gain factors comprises:

transforming the gain factors to a frequency domain representation;

cutting off high frequency components of the frequency domain representation of the gain factors in accordance with the noisy factor; and inverse transforming the frequency domain representation of the gain factors.

3. The speech noise suppression method of claim 1, wherein classifying the frequency bins comprises:

calculating frame energy;

tracking an estimate of noise mean and variance for the frequency bins;

classifying a frequency bin as noisy when the frame energy is lower than a function of the estimate of noise mean and variance of the respective frequency bin for the preceding frame; and updating the estimate of noise mean and variance for frequency bins classified as noisy.

4. The speech noise suppression method of claim 3, further comprising:

smoothing the spectral values; and using the smoothed spectral values in calculating the frame energy and the estimate of noise mean and variance.

5. The speech noise suppression method of claim 3, wherein the smoothing the spectral values comprises performing both time and frequency domain smoothing of the spectral values.

6. The speech noise suppression method of claim 3, further comprising:

calculating a historical low frame energy measure;

determining to reset the estimate of noise mean and variance if the frame energy measure is lower than a first threshold multiple of the historical low frame energy measure;

determining to update the estimate of noise mean and variance for the frequency bins if the frame energy measure is lower than a second threshold multiple of the historical low frame energy measure.

7. The speech noise suppression method of claim 3, wherein the calculating the gain factors comprises:

calculating the gain factors as a function of the estimate of noise mean and variance and the spectral value for the respective frequency bin.

8. A speech noise suppressor, comprising:

means for transforming a frame of an input speech signal to a frequency domain representation having a plurality of spectral values;

means for classifying a plurality of frequency bins as noisy or non-noisy;

means for calculating a plurality of gain factors for the frequency bins;

means for calculating a noisy factor based on a ratio of a number of noisy frequency bins to a total number of frequency bins, varying from a value indicative of no smoothing to a value indicative of smoothing the gain factors to a constant gain;

means for smoothing the gain factors in accordance with the noisy factor; and means for modifying the spectral values by applying the gain factors to correlated spectral values; and means for transforming the modified spectral values to produce an output speech signal.

9. The speech noise suppressor of claim 8, wherein the means for smoothing the gain factors comprises:

means for transforming the gain factors to a frequency domain representation;

means for cutting off high frequency components of the frequency domain representation of the gain factors in accordance with the noisy factor; and means for inverse transforming the frequency domain representation of the gain factors.

10. The speech noise suppressor of claim 8, wherein the means for classifying the frequency bins comprises:

means for calculating frame energy;

means for tracking an estimate of noise mean and variance for the frequency bins;

means for classifying a frequency bin as noisy when the frame energy is lower than a function of the estimate of noise mean and variance of the respective frequency bin for the preceding frame; and means for updating the estimate of noise mean and variance for frequency bins classified as noisy.

11. The speech noise suppressor of claim 10, further comprising:

means for smoothing the spectral values; and means for using the smoothed spectral values in calculating the frame energy and the estimate of noise mean and variance.

12. The speech noise suppressor of claim 10, wherein the means for smoothing the spectral values comprises means for performing both time and frequency domain smoothing of the spectral values.

13. The speech noise suppressor of claim 10, further comprising:

means for calculating a historical low frame energy measure;

means for determining to reset the estimate of noise mean and variance if the frame energy measure is lower than a first threshold multiple of the historical low frame energy measure;

means for determining to update the estimate of noise mean and variance for the frequency bins if the frame energy measure is lower than a second threshold multiple of the historical low frame energy measure.

14. The speech noise suppressor of claim 10, wherein the means for calculating the gain factors comprises:

means for calculating the gain factors as a function of the estimate of noise mean and variance and the spectral value for the respective frequency bin.

15. A method of suppressing noise in a speech signal, comprising:

transforming a frame of an input speech signal to a frequency domain representation having a plurality of spectral values;

calculating frame energy for the frame;

tracking an estimate of noise mean and variance for a plurality of frequency bins;

classifying those of the frequency bins as noisy when the frame energy is lower than a function of the estimate of noise mean and variance of the respective frequency bin for the preceding frame, and otherwise as non-noisy;

calculating a plurality of gain factors for the frequency bins;

calculating a noisy factor based on a ratio of a number of noisy frequency bins to a total number of frequency bins, varying from a value indicative of no smoothing to a value indicative of smoothing the gain factors to a constant gain;

smoothing the gain factors in accordance with the noisy factor; and modifying the spectral values by applying the gain factors to correlated spectral values; and transforming the modified spectral values to produce an output speech signal.

* * * * *